United States Patent [19]

Matsui et al.

[11] Patent Number: 4,565,990

[45] Date of Patent: Jan. 21, 1986

[54] ROTARY OPERATION TYPE MINIATURIZED ELECTRONIC COMPONENT

[75] Inventors: Hiroshi Matsui, Hirakata; Tadashi Mihara; Koji Umino, both of Neyagawa, all of Japan

[73] Assignee: Matsushita Electric Industrial Co., Ltd., Osaka, Japan

[21] Appl. No.: 596,821

[22] Filed: Apr. 3, 1984

[30] Foreign Application Priority Data

Apr. 7, 1983 [JP] Japan ..... 58-52446[U]
Apr. 7, 1983 [JP] Japan ..... 58-52447[U]

[51] Int. Cl.[4] ..... H01C 10/32

[52] U.S. Cl. ..... 338/171; 338/162; 338/202; 338/164

[58] Field of Search ..... 338/162, 164, 166, 184, 338/199, 202, 171; 200/11 D, 11 DO, 11 G, 11 J

[56] References Cited

U.S. PATENT DOCUMENTS

| | | | |
|---|---|---|---|
| 2,257,621 | 9/1941 | Schellenger | 338/171 |
| 2,594,493 | 4/1952 | Puerner | 338/171 |
| 2,717,944 | 9/1955 | Daily et al. | 338/166 |
| 3,237,140 | 2/1966 | Barden et al. | 338/184 X |
| 3,531,860 | 10/1970 | Paine et al. | 338/184 X |
| 3,597,837 | 8/1971 | Mack | 338/162 X |
| 3,906,429 | 9/1975 | Rhodes | 338/171 X |

FOREIGN PATENT DOCUMENTS

| | | | |
|---|---|---|---|
| 1134141 | 8/1962 | Fed. Rep. of Germany | 338/171 |
| 2250460 | 5/1975 | France | 338/162 |

*Primary Examiner*—C. L. Albritton
*Assistant Examiner*—M. M. Lateef
*Attorney, Agent, or Firm*—Wenderoth, Lind & Ponack

[57] ABSTRACT

A rotary operation type miniaturized electronic component for use in video and audio electronic appliances, etc., including a casing formed with an opening and a rotary member. In the electronic component, a metal plate is integrally molded with the casing at a bottom face of the casing and then, is cut so as to form two conductive plates, two terminals for external takeoff, and two legs for mounting the casing on a printed circuit board, while a metal sheet is integrally molded with the rotary member and then, is cut so as to form two rotary sliders. Thus, it becomes possible to perform automatic soldering of the electronic component to the printed circuit board.

9 Claims, 12 Drawing Figures

ROTARY OPERATION TYPE MINIATURIZED ELECTRONIC COMPONENT

BACKGROUND OF THE INVENTION

The present invention generally relates to electronic components and more particularly, to a rotary operation type miniaturized electronic component, for example, a miniaturized variable resistor, a miniaturized switch, etc., for use in various electronic video and audio appliances and the like.

As a prior art of the present invention, a conventional interlocking type miniaturized variable resistor K will be described by way of example with reference to FIGS. 1 to 3, hereinbelow. The known interlocking type miniaturized variable resistor K generally includes a casing 1 of cylindrical shape, a first insulating substrate 2 formed with a central bore 22, a second insulating substrate 3 formed with a central bore 23, and a retainer 4 having a pair of legs 5 such that the first and second insulating substrates 2 and 3 are, respectively, secured to upper and lower ends of the casing 1 by the legs 5 of the retainer 4. Additionally, as shown in FIGS. 2 and 3, a first resistance element 6 of circular shape and a first conductor 8 of circular shape, which are provided coaxially with each other about an axis of the casing 1 such that the first resistance element 6 is disposed radially outwardly of the first conductor 8, are formed on a lower surface of the first insulating substrate 2 by printing, etc. Similarly, a second resistance element 7 of circular shape and a second conductor 9 of circular shape, which are provided coaxially with each other about the axis of the casing 1 such that the second resistance element 7 is disposed radially outwardly of the second conductor 9, are formed on an upper face of the second insulating substrate 3 in alignment with the first resistance element 6 and the first conductor 8 of the first insulating substrate 2, respectively by printing, etc. so as to confront the first resistance element 6 and the second conductor 8, respectively. Furthermore, a pair of terminals 10 and 12 and a terminal 14 are, respectively, attached to opposite ends of the first resistance element 6 and the first conductor 8 by caulking and are bent downwardly so as to be inserted into mounting holes of a printed circuit board 16, respectively such that the terminals 10, 12 and 14 are electrically connected to the printed circuit board 16. Likewise, a pair of terminals 11 and 13 and a terminal 15 are, respectively, attached to opposite ends of the second resistance element 7 and the second conductor 9 by caulking and are bent downwardly so as to be inserted into mounting holes of the printed circuit board 16, respectively such that the terminals 11, 13 and 15 are electrically connected to the printed circuit board 16. Moreover, a pair of mounting legs 17 for mounting the casing 1 on the printed circuit board 16 through insertion of the mounting legs 17 into mounting apertures of the printed circuit board 16 are formed at opposite sides of one of the legs 5 of the retainer 4, while a pair of mounting legs 18 for mounting the casing 1 on the printed circuit board 16 through insertion of the mounting legs 18 into mounting apertures of the printed circuit board 16 are formed at opposite sides of the other one of the legs 5 such that the mounting legs 17 and 18 radially confront each other.

In the casing 1, first and second rotary sliders (movable contacts) 19 and 20 made of elastic metal and a rotary member 21 made of insulating material are further provided such that the first and second rotary sliders 19 and 20 are attached to the rotary member 21. More specifically, the rotary member 21 has an operating shaft portion 24' formed at an upper portion thereof and a stopper projection 25' extending radially outwardly at a lower portion thereof and is rotatably supported by the central bore 22 of the first insulating substrate 2 and the central bore 23 of the second insulating substrate 3 such that the first and second rotary sliders 19 and 20 are, respectively, attached to upper and lower faces of the stopper projection 25', with the operating shaft portion 24' projecting out of the central bore 22 of the first insulating substrate 2. Additionally, the first rotary slider 19 has a pair of elastic contacts 24 and a pair of elastic contacts 25. The elastic contacts 24 and 25 are elastically brought into sliding contact with the first resistance element 6 and the first conductor 8 of the first insulating substrate 2 so as to short-circuit the first resistance element 6 and the first conductor 8. Likewise, the second rotary slider 20 has a pair of elastic contacts 26 and a pair of elastic contacts 27. The elastic contacts 26 and 27 are elastically brought into sliding contact with the second resistance element 7 and the second conductor 9 of the second insulating substrate 3 so as to short-circuit the second resistance element 7 and the second conductor 9. Furthermore, the casing 1 has a protrusion 26' extending radially inwardly at approximately an axial central portion thereof. It should be noted that a rotational angle of the rotary member 21 is regulated through contact of the stopper projection 25' of the rotary member 21 with the protrusion 26' of the casing 1.

Thus, in the prior art variable resistor K, since two interlocking variable resistor members are separately constituted by the first insulating substrate 2 and the first rotary slider 19 and by the second insulating substrate 3 and the second rotary slider 20, respectively and the first and second rotary sliders 19 and 20 are, respectively, attached to the upper and lower faces of the stopper projection 25' of the rotary member 21, the known variable resistor K has such an inconvenience that a difference in change of resistance value between the two interlocking variable resistor members arises due to inaccurate formation of the first and second resistance elements 6 and 7 by printing, etc. as well as by misalignment of the first and second rotary sliders 19 and 20, thereby resulting in a large interlocking error.

Furthermore, the known variable resistor K has such disadvantages that, since the number of constituent elements therefor is fundamentally equal to that of interlocking type ordinary-sized variable resistors, it is difficult to make the known variable resistor K compact in size and a number of assembly processes are required therefor, resulting in an increased production cost.

Furthermore, in the case where dip soldering is employed for soldering a rear face (provided with metal foil) of the printed circuit board 16 by inserting the terminals 10 to 15 into the mounting holes of the printed circuit board 16 and inserting the mounting legs 17 and 18 into the mounting apertures of the printed circuit board 16 as shown in FIG. 2 so as to mount the known variable resistor K on the printed circuit board 16, flux proceeding upwardly from the mounting holes and the mounting apertures of the printed circuit board 16 is likely to penetrate from contact portions between the casing 1 and the second insulating substrate 3 into the variable resistor K through the terminals 10 to 15, thereby causing improper contact. Since the second insulating substrate 3 is disposed quite adjacent to the printed circuit board 16, there is a strong possibility that flux will penetrate the casing 1 onto the second resistance element 7 and the second conductor 9. On the other hand, since the first insulating substrate 2 is rather spaced away from the printed circuit board 16, such a possibility is slim that flux will reach the first resistance element 6 and the first conductor 8. Accordingly, the prior art variable resistor K has been disadvantageous in that, since automatic soldering of the known variable resistor K to the printed circuit board 16 cannot be performed by employing dip soldering, manual soldering is required to be performed therefor, thus resulting in an increased assembly cost.

Moreover, the rotational angle of the rotary member 21 is regulated through contact of the stopper projection 25' of the rotary member 21 with the protrusion 26' of the casing 1 as described above. However, the known variable resistor K has such an inconvenience that, since the casing 1 is made of synthetic resin, etc. and the thickness of the cylindrical wall of the casing 1 cannot be made large so as to make the casing 1 compact in size, the protrusion 26' is readily deformed when subjected to even a relatively small force at the time of contact of the stopper projection 25' with the protrusion 26'.

SUMMARY OF THE INVENTION

Accordingly, an essential object of the present invention is to provide an improved rotary operation type miniaturized electronic component which prevents entry of flux thereinto at the time of its soldering to a printed circuit board and is increased in strength so as to enable automatic soldering of the electronic component to the printed circuit board by employing dip soldering, with substantial elimination of the disadvantages inherent in conventional rotary operation type miniaturized electronic components of this kind.

Another important object of the present invention is to provide an improved rotary operation type miniaturized electronic component of the above described type which is simple in structure, highly reliable in actual use, suitable for mass production at low cost, and can be readily incorporated into various video and audio electronic appliances and the like at low cost.

In accomplishing these and other objects according to one preferred embodiment of the present invention, there is provided an improved rotary operation type miniaturized electronic component comprising: a boxlike casing made of insulating synthetic resin, which has an opening formed at an upper face thereof and a metal plate insert molded at a bottom face thereof such that said metal plate functions as a fixed contact said metal plate being formed with first and second extended portions projecting out of said casing; a connecting terminal which is formed by bending said first extended portion so as to project out of said casing; a movable contact member which is brought into sliding contact with said fixed contact; a cover plate for covering said opening of said casing, which is formed with a through-hole; a retaining leg for securing said cover plate to said casing, which is formed by bending said second extended portion; and an operating means for rotating said movable contact member in said casing, which projects out of said casing through said through-hole of said cover plate.

In accordance with the present invention, since flux is prevented from penetrating into the electronic component at the time of its soldering to the printed circuit board, it becomes possible to perform automatic soldering of the electronic component to the printed circuit board by the use of dip soldering.

BRIEF DESCRIPTION OF THE DRAWINGS

These and other objects and features of the present invention will become apparent from the following description taken in conjunction with the preferred embodiment thereof with reference to the accompanying drawings, in which;

FIG. 7(*c*) is a perspective view of the insert molding portion of FIGS. 7(*a*) and 7(*b*);

Before the description of the present invention proceeds, it is to be noted that like parts are designated by like reference numerals throughout several views of the accompanying drawings.

DETAILED DESCRIPTION OF THE PREFERRED EMBODIMENT

As one example of a rotary operation type miniaturized electronic component, an interlocking type miniaturized variable resistor S according to the present invention will be described with reference to FIGS. 4 to 9, hereinbelow.

Figure 6:
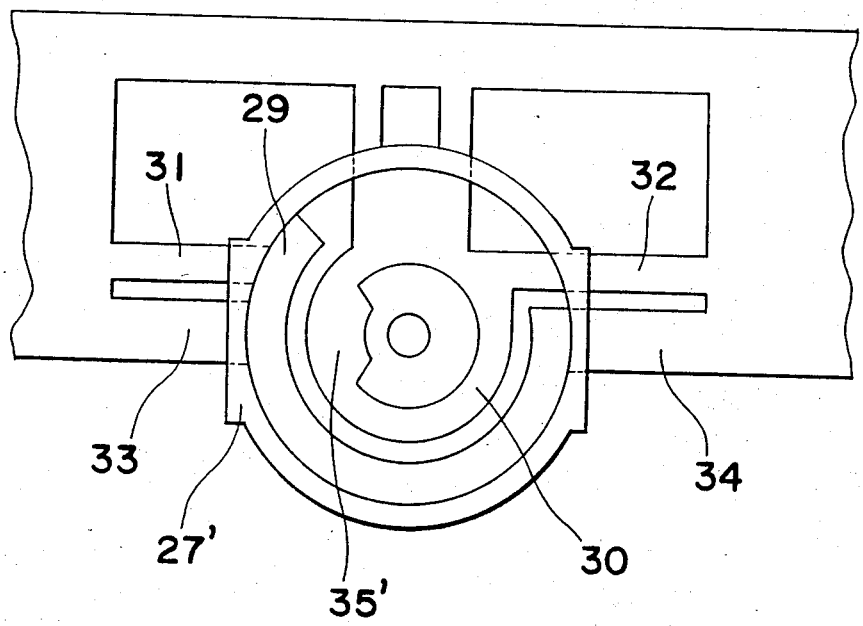
FIGS. 6(*a*) and 6(*b*) are top plan views of an insert molding portion of a casing employed in the variable resistor of FIG. 4.
Figure 6:
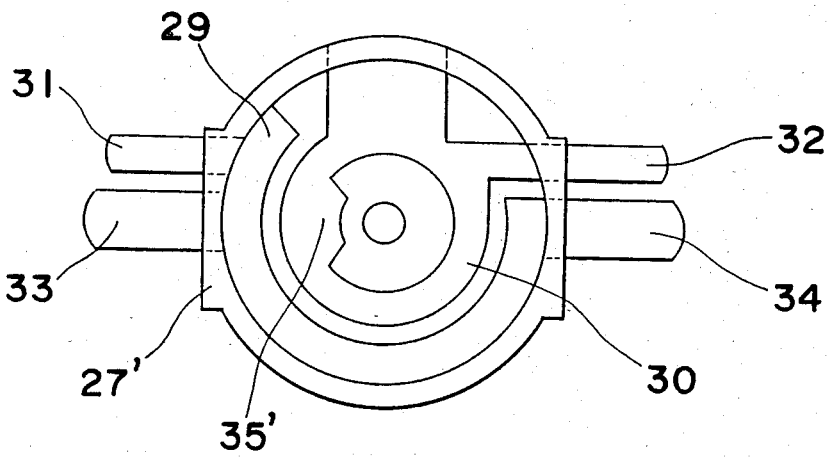

The interlocking type miniaturized variable resistor S generally includes a boxlike cylindrical casing 27' made of insulating synthetic resin and conductive plates 29 and 30 of circular shape, subtending an angle about their center axis in excess of 180°. The casing 27' has an opening formed at a top portion thereof and a bottom portion 28. The conductive plates 29 and 30 are secured, coaxially with each other, to the bottom portion 28 so as to be radially spaced a predetermined distance from each other, with the conductive plate 29 being disposed radially outwardly of the conductive plate 30. Furthermore, terminals 31 and 32 for external takeoff are, respectively, integrally formed with the conductive plates 29 and 30 and are drawn downwardly out of the casing 27'. Mounting legs 29' and 30' for mounting the casing 27' on a printed circuit board 28' are formed by bending inwardly lower portions of the terminals 31 and 32, respectively. A pair of legs 33 and 34 which extend upwardly along opposite sides of the casing 27' from the conductive plate 29 are bent inwardly so as to retain an insulating substrate 35. As shown in FIGS. 6(*a*) and 6(*b*), in order to obtain the conductive plates 29 and 30, the terminals 31 and 32 and the legs 33 and 34, a blanked metal plate is secured to the casing 27' by insert molding it at the time of molding of the casing 27' and then, is subjected to forming by cutting and bending operations.

A protrusion 35' is integrally formed with the conductive plate 30 so as to project radially inwardly such that a rotational angle of a rotary member 36 made of insulating synthetic resin is regulated through contact of the rotary member 36 with the protrusion 35'. In addition, a recess 44 corresponding, in shape, to the inner periphery of the conductive plate 30 and the protrusion 35' is formed at the bottom portion 28 of the casing 27'.

Furthermore, resistance element layers 37 and 38 are formed coaxially with each other on a lower face of the insulating substrate 35 by printing so as to correspond, in position, to the conductive plates 29 and 30, respectively and subtend corresponding angles in excess of 180° about the center axis. A pair of terminals 39 and 40 for external takeoff are, respectively, attached to input and output ends of the resistance element layer 37 by caulking, etc. so as to be electrically conducted through silver paint, etc. Likewise, a pair of terminals 41 and 42 for external takeoff are, respectively, attached to input and output ends of the resistance element layer 38 by caulking, etc. so as to be electrically conducted through silver paint, etc. The terminals 39, 40, 41 and 42 are bent along an outer periphery of the casing 27' in the same manner as the terminal 31 of the conductive plate 29 and the terminal 32 of the conductive plate 30 so as to mount the insulating plate 35 on the printed circuit board 28'.

Figure 7A:
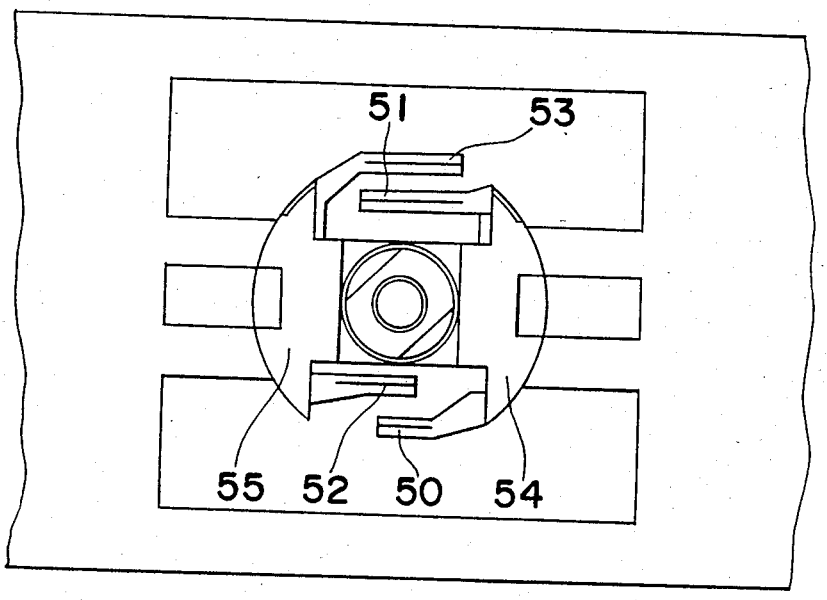
FIGS. 7(*a*) and 7(*b*) are top plan views of an insert molding portion of a rotary member employed in the variable resistor of FIG. 4.
Figure 7B:
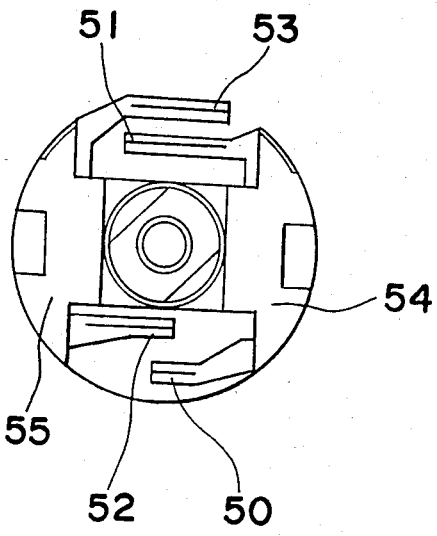
Figure 7C:
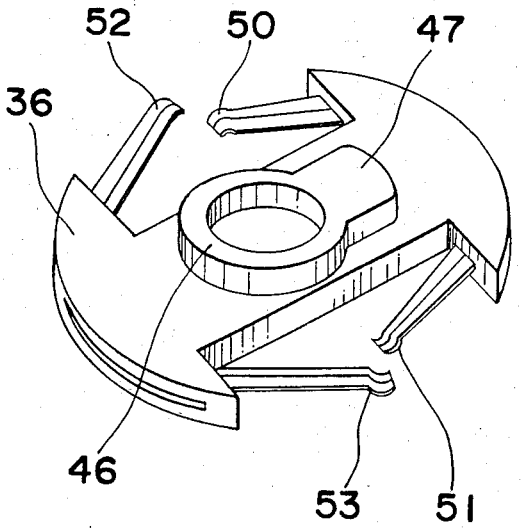

At the bottom portion 28 of the casing 27', a cylindrical central boss 44' is formed on the conductive plates 29 and 30. The insulating substrate 35 is formed with a central bore 45 coaxial with the resistance element layers 37 and 38. As shown in FIG. 7(*c*), an annular portion 46 to be in engagement with the central boss 44' and a rectangular stopper projection 47 are formed on a bottom face of the rotary member 36. The stopper projection 47 is brought into contact with the protrusion 35' of the conductive plate 30 so as to stop rotation of the rotary member 36. The rotary member 36 further has an operating shaft portion 48 formed at an upper portion thereof and is rotatably supported by the central boss 44' and the central bore 45 such that the operating shaft portion 48 projects out of the central bore 45. The rotary member 36 is operated by rotating a knob 49 mounted on the operating shaft portion 48. Furthermore, a pair of rotary sliders 54 and 55 are secured to lower opposite portions of the rotary member 36. The rotary slider 54 has elastic contacts 50 and 51 extending obliquely downwardly and upwardly, respectively such that the elastic contacts 50 and 51 are, respectively, elastically brought into contact with the conductive plate 29 and the resistance element layer 38 so as to short-circuit the conductive plate 29 and the resistance element layer 38. Similarly, the rotary slider 55 has elastic contacts 52 and 53 extending obliquely downwardly and upwardly, respectively such that the elastic contacts 52 and 53 are, respectively, elastically brought into contact with the conductive plate 30 and the resistance element layer 37 so as to short-circuit the conductive plate 30 and the resistance element layer 37. As shown in FIGS. 7(*a*) and 7(*b*), in order to obtain the elastic contacts 50 to 53, a blanked metal sheet is secured to the rotary member 36 by insert molding it at the time of molding of the rotary member 36 and then, is subjected to forming by cutting and bending operations.

By the above described arrangement of the variable resistor S of the present invention, when the rotary member 36, i.e., the rotary sliders 54 and 55 secured to the rotary member 36 are rotated by rotating the knob 49, the elastic contacts 50 and 51 provided on the rotary slider 54 are, respectively, elastically brought into sliding contact with the conductive plate 29 and the resistance element layer 38 by short-circuiting therebetween so as to change values of a resistance between the terminals 31 and 41 (or between the terminals 31 and 42), while, at the same time, the elastic contacts 52 and 53 provided on the rotary slider 55 are, respectively, elastically brought into sliding contact with the conductive plate 30 and the resistance element layer 37 by short-circuiting therebetween so as to change values of a resistance between the terminals 32 and 39 (or between the terminals 32 and 40) in an interlocking relationship with respect to operations of the elastic contacts 50 and 51 of the rotary slider 54.

As is clear from the foregoing description, in the variable resistor S of the present invention, since the resistance element layers 37 and 38 provided for two interlocking variable resistor members, respectively are juxtaposed on the single insulating substrate 35, the resistance element layers 37 and 38 can be formed simultaneously by printing, etc., so that error in the distance therebetween can be restricted to a minimum value. Furthermore, since the elastic contacts 51 and 53 which are, respectively, elastically brought into sliding contact with the resistance element layers 38 and 37 are formed of a single metal sheet and are secured to the rotary member 36 by insert molding, the elastic contacts 51 and 53 can be remarkably accurately positioned relative to each other. Accordingly, a difference in change of resistance value between the two interlocking variable resistor members (an interlocking error) can be minimized.

Figure 1:
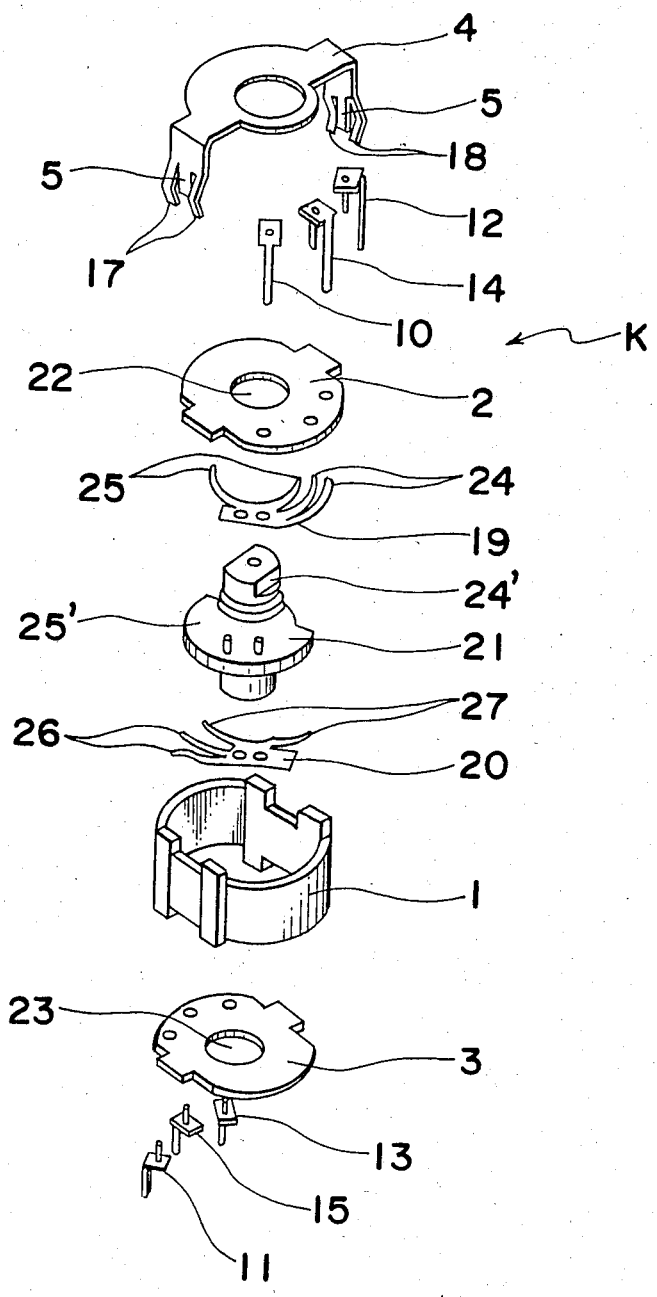
Fig. 1 PRIOR ART
FIG. 1 is an exploded perspective view of a prior art variable resistor (already referred to)
Figure 2:
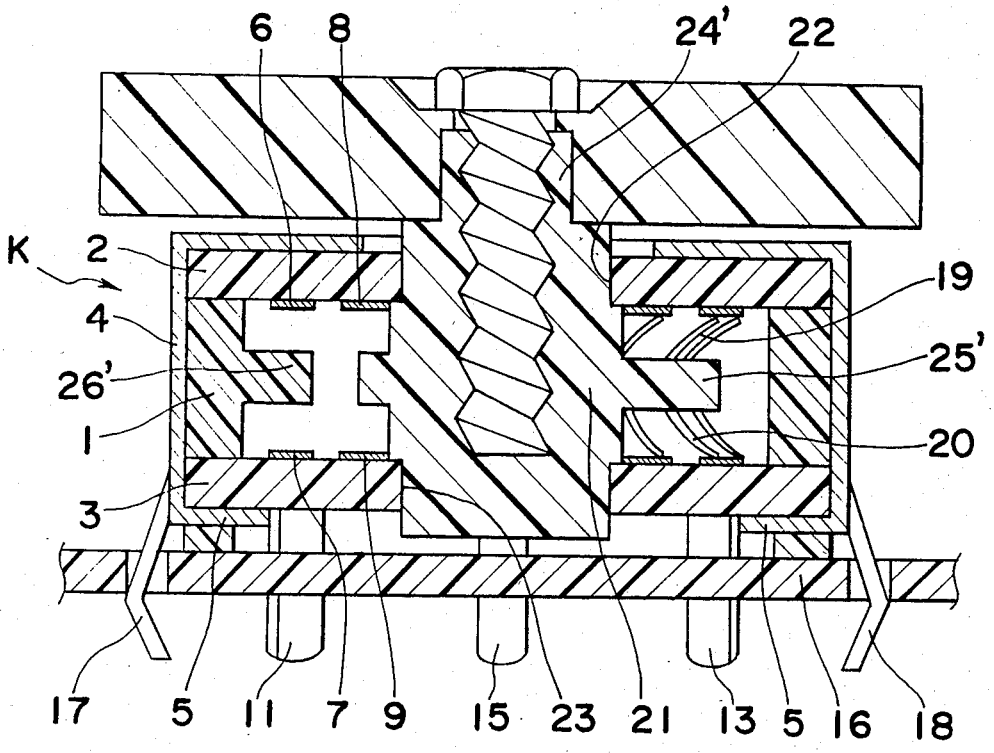
Fig. 2 PRIOR ART
FIG. 2 is a vertical sectional view of the prior art variable resistor of FIG. 1 (already referred to)
Figure 3:
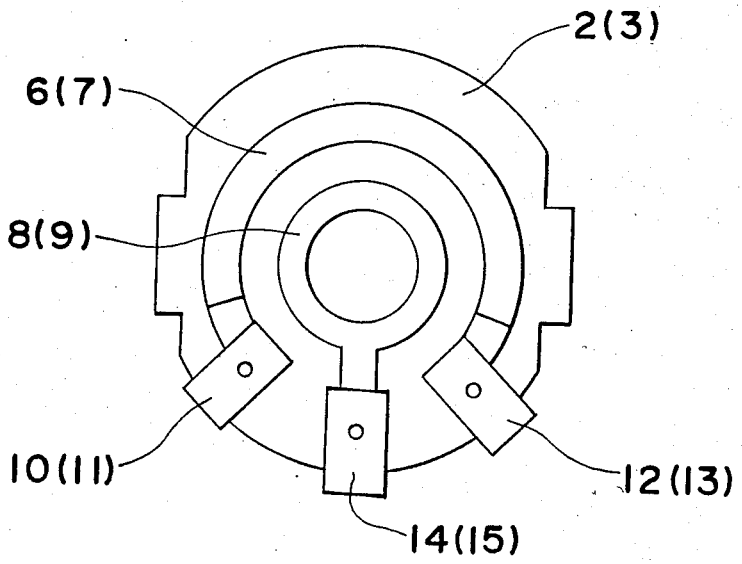
Fig. 3 PRIOR ART
FIG. 3 is a top plan view of an insulating substrate employed in the prior art variable resistor of FIG. 1 (already referred to)
Figure 4:
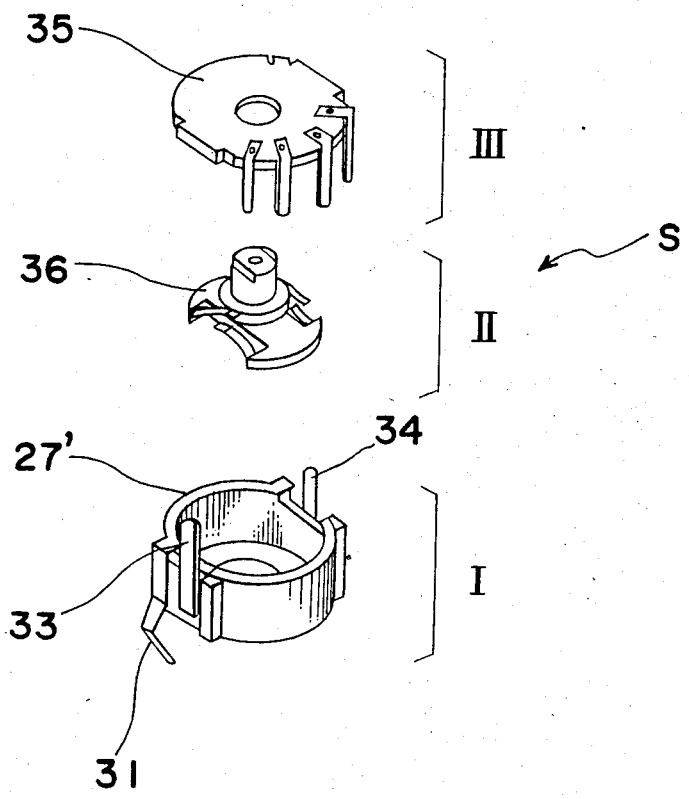
FIG. 4 is an exploded perspective view of a variable resistor according to the present invention.

Meanwhile, in accordance with the present invention, the conductive plates 29 and 30, terminals 31 and 32 and legs 33 and 34 are formed of a single metal plate and are secured to the casing 27' by insert molding, while the rotary sliders 54 and 55 are also formed of a single metal sheet and are secured to the rotary member 36 by insert molding. Consequently, the number of the constituent elements of the variable resistor and the number of assembly processes therefor can be reduced drastically. Namely, as shown in FIG. 4, since the variable resistor can be obtained merely by assembling a molded casing portion I, a molded rotary member portion II and an insulating substrate portion III having the terminals attached thereto, it becomes easy to perform automatic assembly of the variable resistor, thereby resulting in a decrease of its production cost. Moreover, in accordance with the present invention, the variable resistor can be made remarkably compact in size so as to be reduced, in diameter and height, to approximately $\frac{2}{3}$ of prior art variable resistors of this kind.

Figure 8:
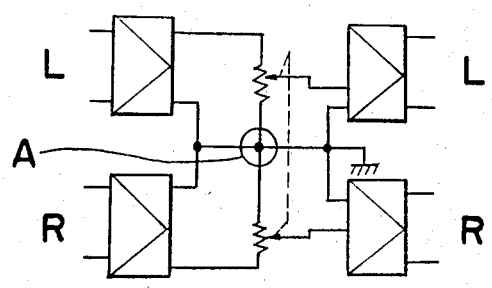
FIG. 8 is an electrical circuit diagram having the variable resistor of FIG. 4 incorporated therein.
Figure 9:
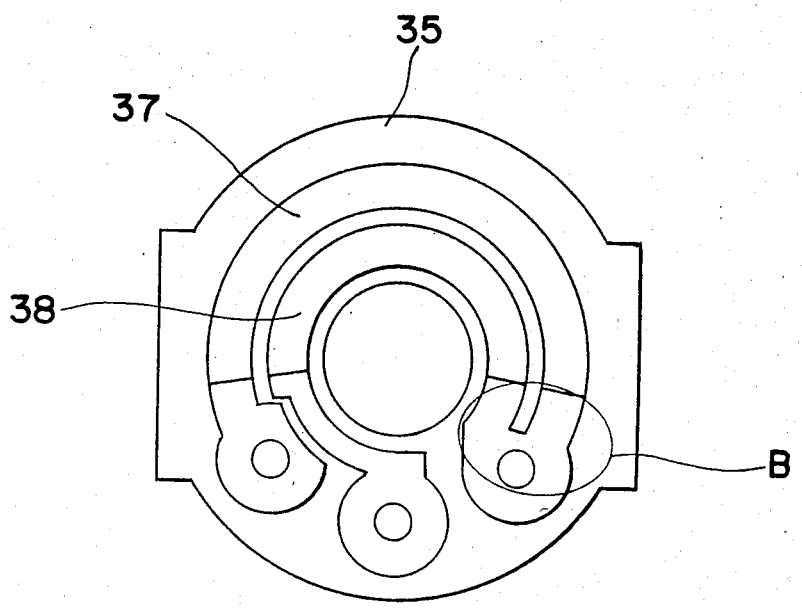
FIG. 9 is a top plan view of an insulating substrate employed in the variable resistor of FIG. 4.

Furthermore, in the case where the interlocking type variable resistor S is generally used for adjusting sound volume, one of the terminals 39 and 40 for the resistance element layer 37 and one of the terminals 41 and 42 for the resistance element layer 38 are short-circuited as shown in the encircled portion A of FIG. 8 and thus, can be beforehand short-circuited on the insulating substrate 35 by the use of silver paint, etc. as shown in the encircled portion B of FIG. 9, so that the terminals for the resistance element layers can be reduced in number, thereby resulting in reduction of the number of wires required for the terminals. In this case, crosstalk between the two interlocking variable resistor members can be minimized by spacing the short-circuit portion (encircled portion B) as far away from a sliding range of the elastic contacts 51 and 53 as possible.

Figure 5:
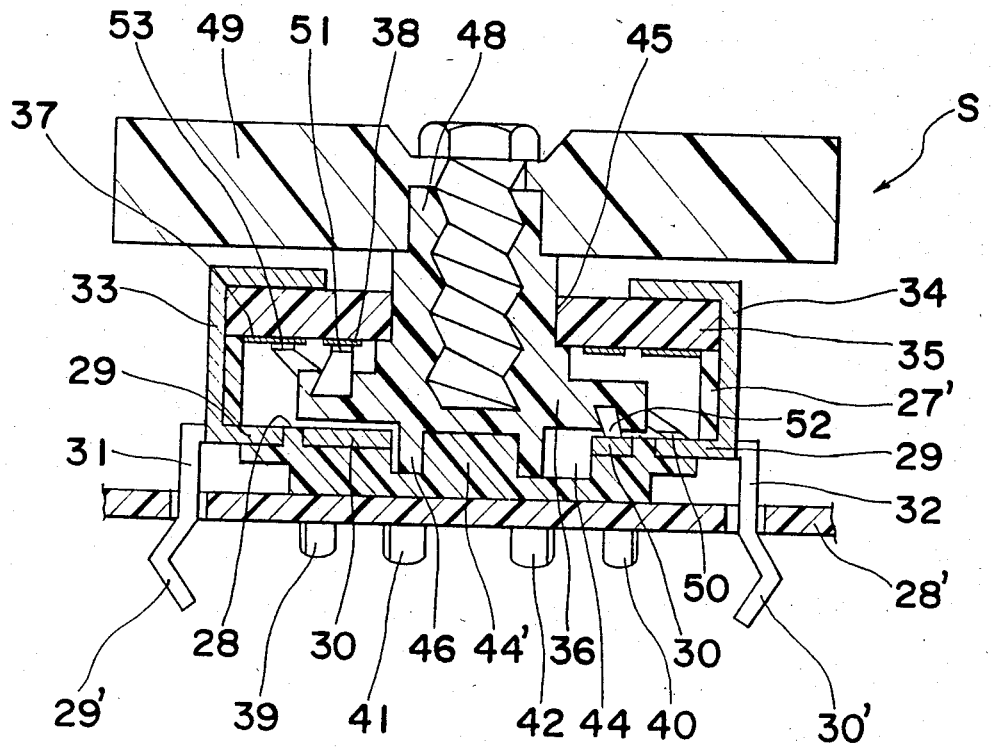
FIG. 5 is a vertical sectional view of the variable resistor of FIG. 4.

As shown in FIG. 5, when the variable resistor S is mounted on the printed circuit board 28', the terminal 31 for the conductive plate (fixed contact) 29, the terminal 32 for the conductive plate (fixed contact) 30, the terminals 39 and 40 for the resistance element layer 37, and the terminals 41 and 42 for the resistance element layer 38 are, respectively, inserted through mounting holes of the printed circuit board 28' and then, are soldered to a rear face (provided with metal foil) of the printed circuit board 28'. Even if the flux penetrates upwardly along the terminals 31 and 32, etc. from the mounting holes of the printing circuit board 28' in this case, upper portions of the terminals 31 and 32 are tightly fitted into the casing 27', so that no clearance is formed between the terminal 31 and the casing 27' and between the terminal 32 and the casing 27' and thus, the flux is blocked by the outer peripheral wall of the casing 27'. Meanwhile, since the insulating substrate 35 is rather spaced away from the printed circuit board 28', such a phenomenon does not take place that flux penetrates from an upper portion of the casing 27' into the casing 27'. Thus, it becomes possible to perform automatic soldering of the variable resistor S to the printed circuit board 28' by employing dip soldering.

Furthermore, since it is so arranged that the rotational angle of the rotary member 36 is regulated through contact of the stopper projection 47 (FIG. 7(*c*)) formed on the bottom face of the rotary member 36 with the protrusion 35' of the conductive plate 30 secured to the bottom portion 28 of the casing 27', the protrusion 35' is not deformed even when subjected to a relatively large force at the time of contact of the stopper projection 47 with the protrusion 35'.

In addition, since the bottom portion 28 disposed below the protrusion 35' is filled with molding material so as to function as a stopper, while the central boss 44' and the protrusion 35' are integrally formed with each other, the protrusion 35' and the stopper projection 47 can be more securely prevented from being damaged upon contact therebetween.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A rotary operation type minaturized eletronic component comprising:

a boxlike casing made of insulating synthetic resin, which has an opening formed at an upper face thereof and a metal plate insert molded at a bottom face thereof such that said metal plate functions as fixed contact;

said metal plate being formed with first and second extended portions projecting out of said casing, said first extended portion being bent so as to project out of said casing to define a connecting terminal, said second extended portion being bent so as to secure said cover plate to said casing, thereby defining a retaining leg;

a movable contact member in sliding contact with said fixed contact;

a cover plate covering said opening of said casing and having a through-hole formed therein and;

an operating means for rotating said movable contact member in said casing, said operating means projecting out of said casing through said through-hole of said cover plate.

2. A rotary operation type miniaturized electronic component comprising:

a boxlike casing made of insulating synthetic resin, which has an opening formed at an upper face thereof and a metal plate insert molded at a bottom face thereof such that said metal plate functions as a fixed contact;

said metal plate being formed with an extended portion projecting out of said casing so as to define a connecting terminal;

a movable contact member in sliding contact with said fixed contact;

a cover plate covering said opening of said casing, secured to said casing and formed with a through-hole;

an operating means for rotating said movable contact member in said casing, which projects out of said casing through said through-hole of said cover plate;

a protrusion formed on said metal plate so as to extend in an inward direction of said casing; and a projection formed on said movable contact member so as to contact said protrusion of said metal plate so as to prevent rotation of said movable contact member when said movable contact member is rotated by said operating means.

3. A rotary operation type miniaturized electronic component as in claim 2, further including a projecting portion identical, in dimensions, with said protrusion of said metal plate, which is integrally formed with said casing.

4. A rotary operation type miniaturized electronic component comprising:

a boxlike casing made of insulating synthetic resin, having an opening formed at an upper face thereof;

first and second circularly arched conductive plates each subtending an angle about a central axis of said casing of at least 180°, on a bottom face of said casing so as to be coaxial with each other about said central axis of said casing such that said first conductive plate is radially outwardly spaced a first predetermined distance from said second conductive plate;

said first and second conductive plates having respective first and second conductive plate terminals for external takeoff;

a retaining leg;

an insulating substrate fastened to said casing by said retaining leg so as to cover said opening of said casing, and formed with a central hole;

first and second circularly arched resistance elements each subtending an angle about said central axis of at least 180°, formed on one face of said insulating substrate confronting said first and second conductive plates in axially spaced relation thereto so as to be coaxial with each other about said central axis of said casing such that said first resistance element is radially outwardly spaced a second predetermined distance from said second resistance element;

said first resistance element having first and second end terminals at respective input and output ends thereof, for external takeoff;

said second resistance element having third and fourth end terminals at respective input and output ends thereof, for external takeoff;

a rotary member made of insulating synthetic resin, rotatably supported between said bottom face of said casing and said insulating substrate so as to be rotatable about said central axis of said casing;

an operating shaft integrally formed with said rotary member so as to project out of said casing through said central hole of said insulating plate; and first and second rotary sliders mounted on said rotary member;

said first rotary slider elastically contacting one of said first and second conductive plates and one of said first and second resistance elements separately from each other so as to short-circuit said one of said first and second conductive plates and said one of said first and second resistance elements;

said second rotary slider elastically contacting the other one of said first and second conductive plates and the other one of said first and second resistance elements separately from each other so as to short-circuit said other one of said first and second conductive plates and said other one of said first and second resistance elements.

5. A rotary operation type miniaturized electronic component as in claim 4, wherein said first and second conductive plates and said retaining leg are formed from a metal plate secured to said casing by insert molding and then cut to form said first and second conductive plates, said first and second conductive plate terminals and said retaining leg such that said first conductive plate and said first conductive plate terminal are electrically isolated from said second conductive plate and said second conductive plate terminal.

6. A rotary operation type miniaturized electronic component as in claim 4, wherein said first and second rotary sliders are formed from a metal sheet secured to said rotary member by insert molding and then cut so as to form said first and second rotary sliders such that said first and second rotary sliders are electrically isolated from each other.

7. A rotary operation type miniaturized electronic component as in claim 4, wherein one of said input and output ends of said first resistance element and one of said input and output ends of said second resistance element are short-circuited out of a rotary sliding range of said first and second rotary sliders by conductive printing, whereby a corresponding one of said first and second end terminals acts also as a corresponding one of said third and fourth end terminals.

8. A rotary operation type miniaturized electronic component comprising:

a boxlike casing formed with an opening;

an insulating substrate secured to said casing so as to cover said opening;

a plurality of resistance elements having a plurality of input ends and a plurality of output ends, one of each for each resistance element, formed coaxially with one another on said insulating substrate about an axis, subtending an angle about said axis of at least 180°;

a plurality of circularly arched conductive plates, one for each of said plurality of resistance elements, each subtending an angle about said axis of at least 180°, coaxially disposed about said axis, axially spaced from said plurality of resistance elements;

a plurality of resistance element terminals electrically connected to said plurality of resistance elements for external takeoff;

a rotary member rotatably supported in said casing by said casing and said insulating substrate so as to be rotatable about said axis by an external operating means;

a plurality of conductive plate terminals electrically connected to said plurality of conductive plates for external takeoff, drawn out of said casing; and a plurality of rotary sliders secured to said rotary member, in sliding contact with respective ones of said resistance elements, and with respective ones of said conductive plates;

one of said plurality outputs ends and said plurality of input ends being connected to one another so as to form connected portions, said resistance element terminals being connected to said connected portions and the other of said plurality of input ends and said plurality of outputs ends.

9. A rotary operation type miniaturized electronic component comprising:

a boxlike casing formed with an opening;

an insulating substrate;

first and second circularly arched resistance elements formed coaxially with each other on said insulating substrate about an axis, subtending an angle about said axis of at least 180°;

said first resistance element having a first input end and a first output end;

said second resistance element having a second input end and a second output end;

a rotary member made of insulating synthetic resin, supported by said casing and said insulating substrate so as to be rotatable by an external operating means about said axis;

first and second circularly arched conductive plates each subtending an angle about said axis of at least 180°, coaxially disposed about said axis axially spaced from said first and second resistance elements;

first and second terminals for external takeoff respectively electrically connected to said first and second conductive plates; and first and second rotary sliders secured to said rotary member in sliding contact with said first resistance element and said first conductive plate and said second resistance element and said second conductive plate, respectively, said first and second rotary sliders being formed from a metal sheet secured to said rotary member by molding and then cut so as to form said first and second rotary sliders.

* * * * *